US006460776B1

(12) United States Patent
Float et al.

(10) Patent No.: US 6,460,776 B1
(45) Date of Patent: Oct. 8, 2002

(54) INSULATED DRINKING STRAW, DRINKING METHOD AND INSULATING ATTACHMENT FOR DRINKING HOT AND COLD LIQUIDS

(76) Inventors: Ardele Y. Float, 2 Shire, Coto de Caza, CA (US) 92679; Kenneth W. Float, 2 Shire, Coto de Caza, CA (US) 92679

( * ) Notice: Subject to any disclaimer, the term of this patent is extended or adjusted under 35 U.S.C. 154(b) by 0 days.

(21) Appl. No.: 09/433,627

(22) Filed: Nov. 3, 1999

Related U.S. Application Data

(63) Continuation-in-part of application No. 09/420,480, filed on Dec. 8, 2000, now abandoned.

(51) Int. Cl.[7] ..... A47G 21/18
(52) U.S. Cl. ..... 239/33
(58) Field of Search ..... 239/33; 138/112, 138/108, 142; 229/103.1; 426/85; 215/229, 388, 399; 220/705–710

(56) References Cited

U.S. PATENT DOCUMENTS

| | | | | | |
|---|---|---|---|---|---|
| 651,425 | A | | 6/1900 | McConnell | |
| 2,192,037 | A | * | 2/1940 | Hamilton | 239/33 |
| 2,288,848 | A | * | 7/1942 | Schuessler | 239/33 |
| 2,815,981 | A | * | 12/1957 | Nonnanmaker | 239/33 |
| 3,718,282 | A | * | 2/1973 | Pizzoferrator | 239/33 |
| 3,957,202 | A | | 5/1976 | Hornsby | |
| 4,857,371 | A | | 8/1989 | McClintock | |
| 5,288,019 | A | | 2/1994 | Gorochow | |
| 5,441,083 | A | * | 8/1995 | Korsgaard | 138/149 |
| 5,507,156 | A | * | 4/1996 | Redmon | 62/400 |
| 5,727,734 | A | * | 3/1998 | Su | 239/33 |
| 5,947,378 | A | * | 9/1999 | Rebotier | 239/33 |

FOREIGN PATENT DOCUMENTS

| | | | | |
|---|---|---|---|---|
| FR | 1307555 | * | 9/1962 | 239/33 |
| GB | 904010 | * | 8/1962 | 239/33 |

* cited by examiner

*Primary Examiner*—Lesley D. Morris
*Assistant Examiner*—Dinh Q. Nguyen
(74) *Attorney, Agent, or Firm*—Kenneth W. Float

(57) ABSTRACT

An insulated drinking straw and an insulating member for use in drinking hot and cold liquids, such as those consumed from a cup or other container. The insulated drinking straw comprises an inner tubular member and an insulating member disposed around a portion of the periphery of the inner tubular member. The insulating member may be used as a separate device. In one embodiment of the insulating member, the insulating member has an inner shaft, an outer shaft connected to the inner shaft such that an air space is formed between the shafts, and a slot is formed in the insulating member between the inner and outer shafts. In another embodiment of the insulating member, the insulating member has an outer shaft, a compressible insulating material having an inner opening that is attached to an inner wall of the outer shaft, and a slot is formed in the compressible insulating material and outer shaft.

19 Claims, 1 Drawing Sheet

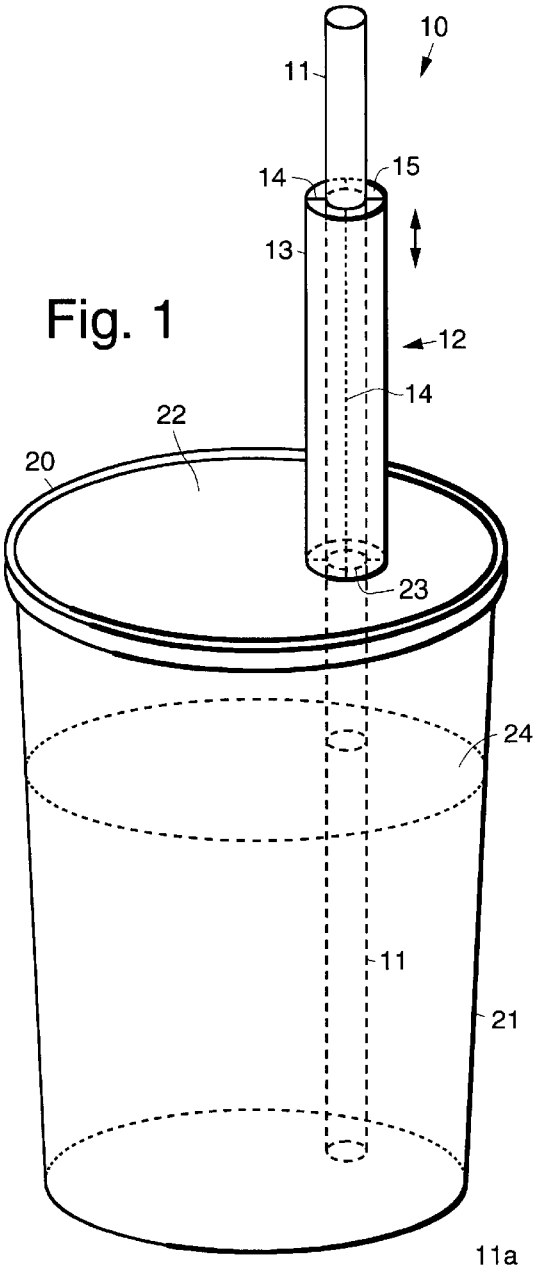
Fig. 1
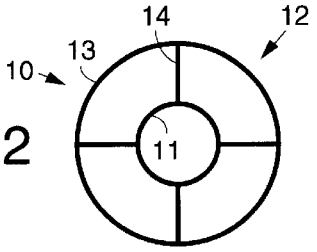
Fig. 2
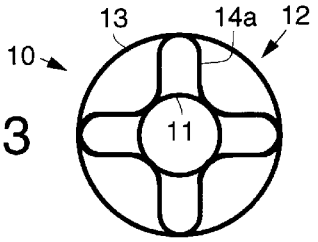
Fig. 3
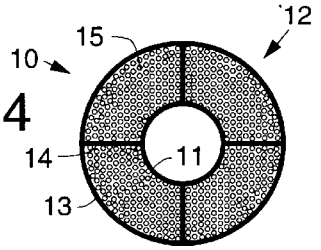
Fig. 4
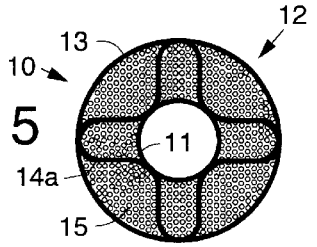
Fig. 5
Fig. 6
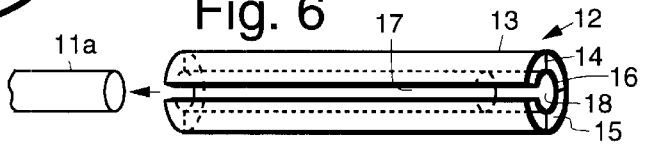
Fig. 7
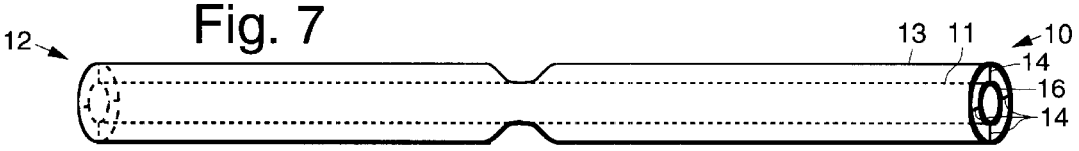
Fig. 8
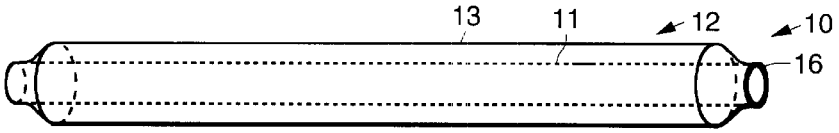

INSULATED DRINKING STRAW, DRINKING METHOD AND INSULATING ATTACHMENT FOR DRINKING HOT AND COLD LIQUIDS

CROSS REFERENCE TO RELATED APPLICATION

This application is a continuation-in-part of U.S. patent application Ser. No. 09/420,480, filed Dec. 8, 2000, now abandoned, which is a continuation-in-part of U.S. patent application Ser. No. 09/189,968, filed Nov. 10, 1998, now abandoned.

BACKGROUND

The present invention relates generally to drinking straws, and more particularly, to an insulated drinking straw and an insulating member that may be used with a drinking straw to drink hot and cold liquids.

Numerous drinking straws have been designed for use in drinking liquid beverages. There are conventional tubular drinking straws, flexible drinking straws, extendable drinking straws that are used to project into milk and orange juice containers, and straws attached to helmets and other devices.

While such conventional drinking straws are designed for drinking cold liquids, none of these devices are particularly well-suited for drinking hot liquids. In particular, coffee drinkers purchase cups of coffee which are drunk on the way to work or while walking around. The cups have lids on them with an opening or openings in them that permit the person to sip the coffee. However, it is very easy to accidentally spill the coffee when drinking from these types of cups, which results in hot coffee spilling onto clothes and skin.

Another problem is that conventional straws which could be used to drink hot beverages are not insulated. Consequently, one's fingers can be scalded or at least feel uncomfortable when drinking hot beverages through them.

Accordingly, it is an objective of the present invention to provide for an insulated drinking straw and an insulating member that may be used with a drinking straw to drink liquids, and in particular, hot liquids.

SUMMARY OF THE INVENTION

To accomplish the above and other objectives, the present invention provides for an insulated drinking straw that may be used with a conventional drinking straw to consume liquids. The present invention is particularly well-suited for use in drinking hot liquids, especially hot liquids that are normally consumed from a cup or other similar container.

The insulated drinking straw comprises an inner straw, such as an inner tubular plastic straw, for example, that has an outer member that is separated from or provides insulation for the inner tubular plastic straw. For example, in one embodiment, an insulating member may be disposed around a portion of the periphery of the inner tubular plastic straw that is in contact with the inner tubular plastic straw. In another embodiment, an outer tubular member is disposed around a portion of the periphery of the inner tubular plastic straw and is separated therefrom. A plurality of connecting members are used to interconnect the outer tubular member to the inner tubular plastic straw. The connecting members may be in the form of a plurality of ribs or fins that connect the inner straw and the outer tubular member.

The relative cross sections of the outer tubular member and the inner tubular plastic straw may be such that fluid is sipped using the inner tubular plastic straw while the outer tubular member is held by the person drinking the fluid. Also, the outer tubular member may be made so that a persons lips are in contact with it instead of the inner tubular plastic straw.

The insulated drinking straw of the present invention is not limited to any particular cross section. Thus, round, elliptical, square, rectangular, triangular or other shaped straws and outer tubular members may be constructed using the principles of the present invention. The insulating member is typically disposed part way down the shaft of the inner straw away from an end thereof that is placed in the person's mouth. The insulating member extends a short distance along the shaft of the straw and is used to grip the insulated drinking straw when drinking the fluid. The balance of the straw extends axially away from the insulating member and is inserted into a container holding the fluid.

The insulating member may formed as a second or outer shaft whose outer dimensions are larger than those of the straw. The outer shaft of the insulating member may be formed to have a cross section that matches the cross section of the straw, although this is not absolutely required. The outer shaft is connected to the straw by means of a plurality of ribs or a serpentine member. Other interconnection members may readily be used.

The space between the outer shaft and the straw may be air, or may be filled with or comprise an insulating material. Any suitable insulating material may be used. Typical insulating materials include elastomeric materials, such as butyl, ethylene, propylene, fluorocarbon, fluorosilicone, neoprene, nitrile, silicone and thermoplastic elastomer, polyolefin tubing, polytetrafluroethylene (PTFE), polystyrene, resin, polyurethane, sponge, cellular silicone, and foam, for example.

The insulating member may also be fabricated as a stand-alone device which may be permanently or temporarily attached to a conventional drinking straw. One embodiment of the insulating member comprises an inner shaft and an outer shaft connected by a plurality of ribs or a serpentine member. The space between the inner and outer shafts may be filled with insulating material. The insulating member has a slot formed therein that permits it to be separated or expanded to slide it over the conventional drinking straw to any desired location along the shaft of the straw.

Because the insulating member is flexible, after it is opened and slid over the conventional drinking straw, it will return to its original shape, which compresses the insulating member against the conventional drinking straw. The inner shaft of the insulating member may be coated with adhesive or have an adhesive strip attached thereto which assists in securing the insulating member to the conventional drinking straw. Thus, the insulating member may be removably or adhesively fixed to a conventional drinking straw.

If the insulating material is a compressible insulating material, the separate insulating member does not require the use of a separate inner shaft. In this case, the compressible insulating material is attached to the inner wall of the outer shaft and has an inner opening. The insulating member may be expanded because of the slot so that the opening may slide over the conventional drinking straw. Once it is in place, the expanded insulating member is allowed to relax so that the compressible insulating material grips the conventional drinking straw to hold it in place.

The insulated drinking straw may be used to drink hot liquids, and is inserted into a cup holding a hot beverage, and the insulating member grasped while drinking the hot beverage, without the risk of burning one's fingers. When the insulated drinking straw is used with a container of hot liquid, there is no need to tip the container to drink the liquid, which minimizes the possibility of accidental spillage. The insulating member also minimizes heat transferred to one's fingers so that scalding is not an issue. The separate insulating member may be readily used with conventional straws to achieve the same results of the insulated drinking straw.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates an embodiment of an insulated drinking straw in accordance with the principles of the present invention;

FIG. 2 is an end view of the insulated drinking straw of FIG. 1;

FIG. 3 is an end view of a second embodiment of the insulated drinking straw;

FIG. 4 is an end view of a third embodiment of the insulated drinking straw;

FIG. 5 is an end view of a fourth embodiment of the insulated drinking straw;

FIG. 6 is a perspective view of an insulating member in accordance with the principles of the present invention;

FIG. 7 illustrates another embodiment of an insulated drinking straw in accordance with the principles of the present invention; and FIG. 8 illustrates yet another embodiment of an insulated drinking straw in accordance with the principles of the present invention.

DETAILED DESCRIPTION

Referring to the drawing figures, FIG. 1 illustrates an embodiment of an insulated drinking straw 10 in accordance with the principles of the present invention. FIG. 2 is an end view of the insulated drinking straw 10. The insulated drinking straw 10 is well-suited for use in drinking fluids 24 or liquids 24, especially hot liquids 24 that are normally consumed from a cup 20 or other container 20. The container 20 is shown as having a body 21 and a lid 22 with an opening 23 or hole 23 therein through which the insulated drinking straw 10 is inserted. However, it is to be understood that the insulated drinking straw 10 may be used with any container 20, with or without a lid 22.

The insulated drinking straw 10 comprises an inner tubular member 11 or straw 11, such as a tubular plastic straw 11, for example, that has an insulating member 12 disposed around at least a portion of the periphery thereof. The inner straw 11 may have a tubular, square, rectangular, triangular, or hexagonal cross section, for example. and the present invention is not limited by the shape of the inner straw 11.

In a typical embodiment of the straw 10, the insulating member 12 is typically disposed part way down the shaft of the inner straw 11 away from an end thereof that is placed in the user's mouth. The insulating member 12 extends a short distance along the shaft of the inner straw 11 and is used to grip the insulated drinking straw 10 when drinking the liquid 24. The balance of the inner straw 11 extends away from the insulating member 12 and is inserted into the container 20 holding the liquid 24.

In the exemplary embodiment of FIG. 1, the insulating member 12 is formed as a second or outer shaft 13 whose outer dimensions are larger than those of the inner straw 11. The outer shaft 13 of the insulating member 12 may be formed to have a cross section that matches the cross section of the inner straw 11, although this is not absolutely required. The outer shaft 13 may be connected to the inner straw 11 by means of a plurality of ribs 14 extending therebetween, as is shown in FIGS. 1 and 2. Alternatively, the outer shaft 13 may be connected to the inner straw 11 by means of a serpentine member 14*a* connected therebetween. FIG. 3 is an end view of a second embodiment of the insulated drinking straw 10 that uses the serpentine member 14*a* to connect the outer shaft 13 to the inner straw 11. Other interconnection members may readily be used.

The space between the outer shaft and the inner straw 11 may be air as is shown in FIGS. 1–3, or may be filled with an insulating material 15. FIGS. 4 and 5 are end views of third and fourth embodiments of the insulated drinking straw 10 that also include insulating material 15. Any insulating material 15 may be used. However, typical insulating materials 15 include foam, butyl, ethylene, propylene, fluorocarbon, fluorosilicone, neoprene, nitrile, silicone and thermoplastic elastomer, polyolefin, polytetrafluroethylene (PTFE), polystyrene, resin, polyurethane, sponge, cellular silicone, polymer, cellulose acetate or other synthetic fiber, for example. Such insulating materials 15 are readily available or may be readily made and inserted between the outer shaft 13 and the inner straw 11 of the insulated drinking straw 10.

Referring now to FIG. 6, it shows a perspective view of an separate insulating member 12 in accordance with the principles of the present invention. The insulating member 12 may be fabricated as a stand-alone device which may be permanently or temporarily attached to a conventional drinking straw 11*a* used by a person. The insulating member 12 comprises an inner shaft 16 and an outer shaft 13 which are connected by means of ribs 14 or a serpentine member 14*a*. The space between the inner and outer shafts 16, 14 may be filled with insulating material 15. The insulating member 12 has a slot 17 formed therein that permits it to be separated or expanded to slide it over the conventional drinking straw 11*a* to any desired location along the shaft of the conventional drinking straw 11*a*.

Because the insulating member 12 is flexible after it is opened and slid over the conventional drinking straw 11*a*, it will return to its original shape, which compresses the insulating member 12 against the conventional drinking straw 11*a*. The insulating member 12 may be positioned at any desired position along the length of the straw 11 (as is indicated by the double headed vertical arrow). In particular the insulating member 12 may be positioned at the upper end of the straw 11 so that a person's lips touch the insulating member 12 and not the straw 11. The inner shaft 16 of the insulating member 12 may be coated with adhesive 18 or have an adhesive strip 18 attached thereto which assists in securing the insulating member 12 to the conventional drinking straw 11*a*. Thus, the insulating member 12 may be removably or adhesively fixed to the conventional drinking straw 11*a*.

Alternatively, if the insulating material 15 is a compressible insulating material 15, such as foam or plastic, for example, the separate insulating member 12 does not require the use of the inner shaft 16. In this embodiment, the compressible insulating material 15 is attached to the inner wall of the outer shaft 13 and has an inner opening 17 with dimensions that correspond to those of the inner shaft 14 of the previously disclosed embodiment. The insulating member 12 may be expanded because of the slot 17 so that the opening 17 may slide over the conventional drinking straw 11*a*. Once it is in place, the expanded insulating member 12 is allowed to relax so that the foam or other compressible insulating material 15 grips the conventional drinking straw 11*a* to hold the separate insulating member 12 in place.

FIG. 7 illustrates a another embodiment of the insulated drinking straw 10. In this embodiment of the drinking straw 10, the inner tubular member 11, or straw 11, and the outer insulating member 12 are coextensive, in that they have substantially the same length. This embodiment is a preferred embodiment that may be manufactured using a plastic extrusion process, for example. Useful lengths of the insulated drinking straw 10 shown in FIG. 7 may be cut from relatively long extruded lengths of the drinking straw 10.

Alternatively the outer insulating member 12 or inner tubular member 11) with attached ribs 14 may be extruded, and then subsequently attached to the inner tubular member 11 (or outer insulating member 12) using plastic welding processes, for example. Also, the inner tubular member 11, the serpentine member 14*a* and the outer insulating member 12 may be separately extruded, cut to length, assembled, and then secured (welded) together to form the finished straw 10.

In the embodiment of the insulated drinking straw 10 shown in FIG. 7, the outer insulating member 12 is made so that a person's lips are in contact with it instead of the inner tubular member 11. This embodiment is specifically designed to help protect a person's lips from contacting the liquid while drinking hot or cold liquid, since the liquid may be drawn into the mouth with the persons lops contacting the outer insulating member 12 without the lips contacting the inner tubular member 11, or straw 11, which may be relatively hot. This minimizes possible burning of the lips when drinking very hot coffee, for example.

This embodiment of the insulated drinking straw 10 may also be configured in a manner similar to the embodiment shown in FIG. 1, wherein respective ends of the inner tubular member 11 and outer insulating member 12 are adjacent each other at the upper end of the straw 10 (as shown in FIG. 7), and the inner tubular member 11 protrudes into the container 20 as shown in FIG. 1 and the outer insulating member 12 terminates adjacent the lid 22 of the cup 20 of container 20.

In the embodiment shown in FIG. 7, the inner tubular member 11 and outer insulating member 12 are shown connected by a plurality of ribs 14 or a serpentine member 14*a* extending therebetween as is shown in FIGS. 2 and 3, and the space therebetween is air. However, it is to be understood that other types of connections may be made between the inner tubular member 11 and outer insulating member 12.

For example, the inner tubular member 11 and outer insulating member 12 may be connected by plastic connecting rods (which may be illustrated by the plurality of ribs 14 shown in FIG. 2, but wherein the ribs are formed as rods adjacent respective ends of the inner tubular member 11 and outer insulating member 12. The inner tubular member 11 and outer insulating member 12 may be connected using doughnut shaped disks, for example, that are secured between the inner tubular member 11 and outer insulating member 12. The doughnut shaped disks may also be used to seal the inner tubular member 11 and outer insulating member 12 if additional insulating material disposed therebetween.

FIG. 7 also shows sealing of the drinking straw 10 generally near the center of the straw 10. The inner tubular member 11 and the outer insulating member 12 are sealed by heating the outer insulating member 12 so that it is fused (sealed) to the inner tubular member 11. This prevents liquid from contacting the upper portion of the outer insulating member 12, which keeps it relatively cool so that fingers and lips of a person that contact the upper portion of the outer insulating member 12 are not exposed to excessive temperatures.

FIG. 8 illustrates yet a another embodiment of the insulated drinking straw 10. In this embodiment of the drinking straw 10, the inner tubular member 11, or straw 11, and the outer insulating member 12 are substantially coextensive, and are sealed at distal ends thereof. The distal ends of the straw 10 may be sealed by heating the outer insulating member 12 so that it is fused (sealed) with the inner tubular member 11 at respective ends of the drinking straw 10. Again, this prevents liquid from contacting the upper portion of the outer insulating member 12, which keeps it relatively cool so that fingers and lips of a person that contact the upper portion of the outer insulating member 12 are not exposed to excessive temperatures.

This embodiment of the drinking straw 10 may be formed having the ribs 14 or the serpentine member 14*a* disposed between the inner tubular member 11 and the outer insulating member 12. However, and quite importantly, this embodiment of the drinking straw 10 may not require the use of any separate connecting elements, such as the ribs 14 or serpentine member 14*a*. In particular, the sealing procedure secures the outer insulating member 12 to the inner tubular member 11 at opposite ends of the straw 10, thus eliminating the need for separate connecting elements. However, versions of the drinking straw 10 containing the connecting elements (ribs 14 or serpentine member 14*a*) may also be made with fused distal ends.

This embodiment is also a preferred embodiment that may be manufactured using a plastic extrusion process, for example. Useful lengths of the insulated drinking straw 10 shown in FIG. 8 may be formed as part of the heating or fusing procedure. During manufacture, the inner tubular member 11 and the outer insulating member 12 (with or without the connecting ribs 14 or serpentine member 14*a*) are extruded in concentric fashion and then cooled, using water, for example. Once the concentric members 11, 12 are cooled, a clamp-like heating element may be used to grip the extruded concentric members 11, 12 and melt the outer insulating member 12 so that it is fused to the inner tubular member 11. A cutting device may then cut the drinking straw 10 at a break point between two straws 11 which is adjacent the center of the section that is fused. Thus, the fusing and cutting procedure may be done concurrently to form various useful lengths of the drinking straw 10.

The present invention also provides for a method of drinking a liquid 24 from a container 20. The method comprises the following steps. A liquid 24 is disposed in a container 20. An insulated drinking straw 10 is inserted into the container 20 that comprises inner tubular member 11 and an outer insulating member 12 disposed around at least a portion of the periphery of the inner tubular member that is coupled to and is separated from the inner tubular member to provide an air space therebetween. A person then drinks the liquid 24 from the container 20 by inserting the straw 10 into his or her mouth so that the outer insulating member 12 is in contact with his or her lips, and the liquid 24 is draws (or sucked) from the container 20 into his or her mouth. Furthermore, a lid 22 may be disposed on the container 20 to keep the liquid from spilling or cooling. In this case, the insulated drinking straw 20 is inserted through an opening 23 in the lid 22 into the container 20.

The insulated drinking straw 10 may be readily used to drink hot liquids 24. The insulated drinking straw 10 may be inserted into a cup of coffee or other hot beverage or liquid 24 and the insulating member grasped while drinking the hot beverage, without the risk of burning one's fingers. When the insulated drinking straw 10 is used with a container 20 of hot liquid 24, there is no need to tip the container 20 to drink the liquid 24, which minimizes the possibility of accidental spillage. The insulating member 12 also minimizes heat transferred to one's fingers so that scalding is not an issue. The separate insulating member 12 may be readily used with conventional straws to achieve the same results of the insulated drinking straw 10.

Furthermore, the insulated drinking straw 10 may be used to drink a cup of coffee or other hot beverage or liquid 24 without the risk of burning one's lips. With embodiments of the insulated drinking straw 10, when they are inserted into a person's mouth, the person's lips contact the outer insulating member 12, while the hot liquid is drawn into the person's mouth. Thus, the hot liquid does not directly contact the person's.

Thus, an improved insulated drinking straw and an insulating member that may be used with a drinking straw to drink liquids, and in particular, hot liquids have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An insulated drinking straw comprising:

an inner tubular member; and an outer insulating member disposed around the inner tubular member that is substantially coextensive with the inner tubular member adjacent an end of the straw that contacts a person's lips, and which is separated from the inner tubular member to provide an air space therebetween adjacent the end of the straw that contacts the person's lips, and that is coupled to the inner tubular member at one or more predetermined locations, and wherein the outer surface of the outer insulating member is disposed to contact the person's lips while drinking with the straw.

2. The insulated drinking straw recited in claim 1 wherein the outer insulating member comprises an outer shaft that is connected to the inner tubular member, and has outer dimensions that are larger than those of the inner tubular member.

3. The insulated drinking straw recited in claim 1 wherein the outer insulating member is disposed adjacent to a drinking end of the straw.

4. The insulated drinking straw recited in claim 1 wherein the inner tubular member comprises a tubular plastic straw.

5. The insulated drinking straw recited in claim 1 wherein the outer insulating member has a cross section that matches the cross section of the inner tubular member.

6. The insulated drinking straw recited in claim 1 wherein the outer insulating member is connected to the inner tubular member by a plurality of ribs extending therebetween.

7. The insulated drinking straw recited in claim 1 wherein the outer insulating member is connected to the inner tubular member by a serpentine member extending therebetween.

8. The insulated drinking straw recited in claim 1 further comprising an insulating material disposed between the inner tubular member and outer insulating member.

9. The insulated drinking straw recited in claim 8 wherein the insulating material consists of a material from the group including foam, butyl, ethylene, propylene, fluorocarbon, fluorosilicone, neoprene, nitrile, silicone and thermoplastic elastomer, polyolefin, polytetrafluroethylene, polystyrene, resin, polyurethane, sponge, cellular silicone, polymer, cellulose acetate, and synthetic fiber.

10. The insulated drinking straw recited in claim 1 wherein distal ends of the outer insulating member and inner tubular member are sealed together.

11. The insulated drinking straw recited in claim 1 wherein the outer insulating member is connected to the inner tubular member at a plurality of locations that are separated by one or more predetermined distances from each respective end of the straw.

12. The insulated drinking straw recited in claim 1 wherein the outer insulating member is connected to the inner tubular member in a single area of the straw that is separated by a predetermined distance from each respective end of the straw.

13. The insulated drinking straw recited in claim 1 wherein the outer insulating member and inner tubular member are sealed together adjacent the end of the straw that contacts a person's lips.

14. The insulated drinking straw recited in claim 1 wherein the outer insulating member is coupled to the inner tubular member at one or more predetermined locations to prevent liquid from passing through the space between the inner tubular member and outer insulating member.

15. A method of drinking a liquid from a container comprising the steps of:

disposing liquid in a container;

inserting an insulated drinking straw into the container that comprises an inner tubular member and an outer insulating member disposed around at least a portion of the inner tubular member that is substantially coextensive with the inner tubular member adjacent an end of the straw that contacts a person's lips, and which is separated from the inner tubular member to provide an air space therebetween adjacent the end of the straw that contacts the person's lips, and that is coupled to the inner tubular member, and wherein the outer surface of the outer insulating member is disposed to contact a person's lips while drinking with the straw;

inserting the drinking end of the insulated drinking straw into a person's mouth; and drawing the liquid from the container into the person's mouth such that the person's lips contact the outer surface of the outer insulating member.

16. The method recited in claim 15 wherein distal ends of the outer insulating member and inner tubular member of the insulated drinking straw are sealed together.

17. The method recited in claim 15 further comprising the steps of:

disposing a lid on the container; and inserting the insulated drinking straw through an opening in the lid into the container.

18. The method recited in claim 15 wherein the outer insulating member and inner tubular member are sealed together adjacent the end of the straw that contacts a person's lips.

19. The method recited in claim 15 wherein the outer insulating member and inner tubular member is coupled to the inner tubular member at one or more predetermined locations to prevent liquid from passing through the space between the inner tubular member and outer insulating member.

* * * * *